US007143600B2

(12) United States Patent
DeSantis et al.

(10) Patent No.: US 7,143,600 B2
(45) Date of Patent: Dec. 5, 2006

(54) WATER CHILLER

(75) Inventors: Paul DeSantis, Racine, WI (US); Terrence Snyder, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/904,725

(22) Filed: Nov. 24, 2004

(65) Prior Publication Data

US 2005/0204750 A1 Sep. 22, 2005

Related U.S. Application Data

(60) Provisional application No. 60/481,712, filed on Nov. 26, 2003.

(51) Int. Cl.
*B67D 5/62* (2006.01)

(52) U.S. Cl. ..... 62/389; 62/3.2; 62/3.64

(58) Field of Classification Search ..... 62/3.2, 62/3.64, 177, 364, 389, 391; 222/146.6
See application file for complete search history.

(56) References Cited

U.S. PATENT DOCUMENTS

| | | | | |
|---|---|---|---|---|
| 5,111,966 | A * | 5/1992 | Fridman | 222/1 |
| 5,544,489 | A | 8/1996 | Moren | |
| 5,845,504 | A * | 12/1998 | LeBleu | 62/92 |
| 6,131,393 | A | 10/2000 | Greene | |
| 6,237,345 | B1 | 5/2001 | Kalman et al. | |
| 6,477,855 | B1 | 11/2002 | Findley et al. | |

* cited by examiner

*Primary Examiner*—Melvin Jones
(74) *Attorney, Agent, or Firm*—Locke Liddell & Sapp LLP

(57) ABSTRACT

A water chilling system includes a reservoir having an inlet and an outlet and a cooling device, such as a thermoelectric cooling probe, situated to cool water contained in the reservoir. A baffle is situated adjacent the inlet to direct water entering the reservoir to a predetermined area of the reservoir such the warmer water entering the reservoir does not immediately mix with the chilled water near the cooling probe.

18 Claims, 1 Drawing Sheet

WATER CHILLER

CROSS REFERENCE TO RELATED APPLICATION

This is a nonprovisional application of U.S. Provisional Patent Application No. 60/481,712, filed on Nov. 26, 2003, which is incorporated by reference.

BACKGROUND

The present disclosure relates generally to water chillers, and more specifically, to thermoelectric water chillers.

Water chillers that store and provide cool water for drinking are well known. The chilled water is stored in a reservoir and dispensed through a faucet for consumption. A thermoelectric device is a popular means of chilling the water in the reservoir. U.S. Pat. No. 5,544,489 to Moren, which is incorporated by reference, discloses a cooled liquid dispenser that uses a thermoelectric device to cool the liquid.

FIG. 1 is a block diagram conceptually illustrating portions of a typical thermoelectric water chiller. A reservoir 10 has a water inlet 12 and a water outlet 14. A cooling probe 20 extends through an opening in the reservoir 10 into the reservoir to chill water contained therein. As chilled water is dispensed via the outlet 14, water is drawn into the reservoir 10 via the inlet 12 to be chilled.

With typical water chillers, the outlet 14 is situated so as to draw water from near the bottom of the reservoir 10—the tube for the outlet 14 extends to near the bottom of the reservoir 10. However, the warm water entering the reservoir 10 through the inlet 12 flows unobstructed directly towards the outlet tube at the bottom of the reservoir 10. This unrestricted flow of warm supply water causes thermal mixing of the warm inlet water and the stored chilled water, resulting in warmer output water.

Further, a vent opening 26 is typically provided in the outlet tube 14. Prior to being filled with water, the reservoir 10 is filled with air. When the reservoir is initially filled with water, the vent opening 26 allows the air to escape from the reservoir 10. Unfortunately, the vent opening 26 also allows warmer water from the top of the reservoir 10 to mix with the chilled water drawn from the bottom of the reservoir 10 when water is drawn from the reservoir 10 via the outlet 14, thus warming the output water as it is dispensed.

Still further, known water chiller devices have an unregulated flow of water into the reservoir 10 through the inlet 12. This results in varying water pressure and flow through the reservoir 10, varying the effectiveness of the device.

The device of the present disclosure addresses shortcomings associated with the prior art.

BRIEF DESCRIPTION OF THE DRAWINGS

Other objects and advantages of the invention will become apparent upon reading the following detailed description and upon reference to the drawings in which.

Figure 1:
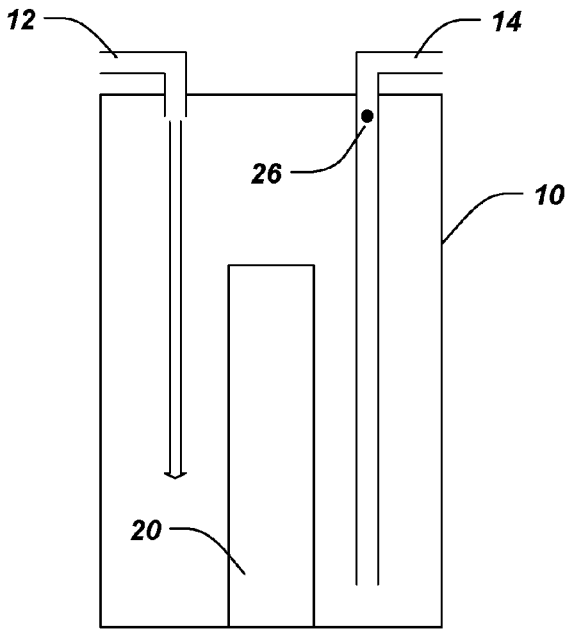
FIG. 1 (prior art)
FIG. 1 is a block diagram of a prior art water chiller.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

SUMMARY

A water chilling system in accordance with aspects of the teachings of this disclosure includes a reservoir having an inlet and an outlet and a cooling device, such as a thermoelectric cooling probe, situated to cool water contained in the reservoir. A baffle is situated adjacent the inlet to direct water entering the reservoir to a predetermined area of the reservoir. Typically, the cooling probe extends into the reservoir from a bottom surface of the reservoir. The baffle is positioned relative to the inlet, or connected to the inlet, to direct warmer incoming water such that it does not immediately mix with the chilled water near the cooling probe at the bottom of the reservoir.

In certain exemplary embodiments, the reservoir defines an opening therethrough to allow air to escape from the reservoir when it is filled with water. Once the reservoir has been filled and the air has been purged from the reservoir, the opening can be sealed to improve efficiency of the water chilling process. Moreover, a flow control device may be provided in the inlet and/or outlet to regulate flow rate as desired.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
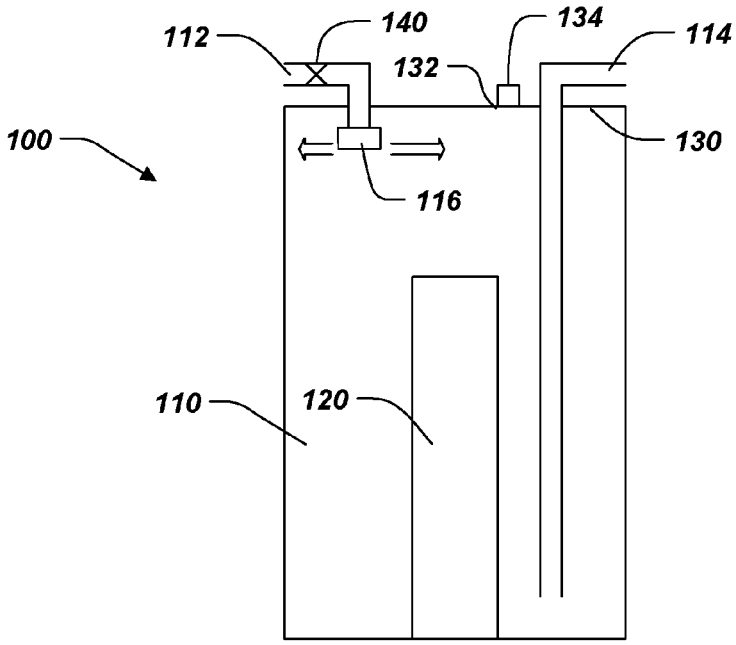
FIG. 2 is a block diagram of a water chiller in accordance with aspects of the present disclosure.

FIG. 2 is a block diagram of an exemplary improved water chiller device 100. The water chiller 100 includes a reservoir 110 with an inlet 112 and an outlet 114. The outlet 114 is typically connected to a faucet to allow dispensing of chilled water by a user. A cooling probe 120 extends into the reservoir 110 to chill water contained in the reservoir 110. In the illustrated embodiment, a thermoelectric cooling probe is used. The outlet 114 extends to the bottom of the reservoir so as to dispense the coldest water in the area of the cooling probe 120. The reservoir 110 usually is insulated.

A baffle 116 is situated to direct incoming water to the top portion of the reservoir 110. In the illustrated embodiment, the baffle 116 is connected to the inlet 114. This reduces the amount of direct mixing of the warm inlet water with the chilled water at the bottom of the reservoir 110. Incoming tap water is typically about 80° F., while water in the reservoir 110 is considered "chilled" when it is below about 50 F. Water is drawn into the reservoir 110 through the inlet 112 as water is dispensed through the outlet 114. The baffle 116 reduces or delays the mixing of the incoming water with the chilled water, allowing a longer draw of chilled water.

When a water chiller unit is initially installed, air inside the reservoir 110 must be purged when the reservoir is filled with water. This is a one-time occurrence. An opening 132 is defined in the top 130 of the device 100. When the reservoir 110 is initially filled with water, the opening 132 allows the air contained in the reservoir 110 to escape from the reservoir 110. Once the reservoir 110 is filled with water, the opening is closed with a plug/seal 134. This allows the use of an outlet 114 that has an opening only at the bottom area of the reservoir 110—no additional vent hole in the outlet 114 is required. Accordingly, only the chilled water near the cooling probe 120 is released through the outlet 114.

Moreover, to control water flow through the reservoir 110, a flow control device 140 is provided in exemplary embodiments. The flow control device 140 is shown in the inlet 112, though it could be located on either the inlet 112 or the outlet 114. The flow control 140 causes slower flow, which has less turbulence and therefore less mixing of the warm and chilled water. Ideally, a water chiller outputs a maximum amount of chilled water. In a perfect design, a 100 ounce tank will provide 100 ounces of chilled water then immediately change to 80° F. (supply water temp). When the warmer supply water mixes with the chilled water, it shows up as a gradual change in water temperature. A sharper change in temperature indicates less mixing.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. A water chilling system, comprising:
a reservoir having an inlet and an outlet;
a cooling device situated in a bottom area of the reservoir to cool water contained in the reservoir;
a baffle situated adjacent the inlet to direct water entering the reservoir to a top area of the reservoir;
an opening defined by the reservoir for allowing air to escape from the reservoir when the reservoir is filled with water; and
a plug for sealing the opening.

2. The water chilling system of claim 1, wherein the cooling device comprises a thermoelectric cooling probe.

3. The water chilling system of claim 2, wherein the cooling probe extends into the reservoir from a bottom surface of the reservoir.

4. The water chilling system of claim 1, wherein the baffle is connected to the inlet.

5. The water chilling system of claim 1, further comprising a flow control device situated in the inlet.

6. The water chilling system of claim 1, further comprising a flow control device situated in the outlet.

7. A method of chilling water, comprising:
providing a water cooling device in a bottom area of a reservoir;
receiving water to be chilled into a reservoir via an inlet;
directing the water entering the reservoir to an upper portion of the reservoir;
releasing air from the reservoir through a vent opening as the water is received into the reservoir; and
sealing the vent opening after the reservoir is filled with water.

8. The method of claim 7, further comprising controlling the flow rate of water entering the reservoir.

9. The method of claim 7, further comprising controlling the flow rate of water exiting the reservoir.

10. A water chilling device, comprising:
a reservoir for containing water;
an inlet for receiving water into the reservoir;
an outlet for dispensing water from the reservoir;
means for chilling water contained in a bottom area of the reservoir;
means for directing water received through the inlet to a top area of the reservoir;
means for venting air from the reservoir; and
means for sealing the means for venting.

11. A water chilling system, comprising:
a reservoir having an inlet and an outlet;
a cooling device situated to cool water contained in the reservoir;
a baffle situated adjacent the inlet to direct water entering the reservoir to a predetermined area of the reservoir;
an opening defined by the reservoir for allowing air to escape from the reservoir when the reservoir is filled with water; and
a plug for sealing the opening.

12. The water chilling system of claim 11, wherein the cooling device is positioned in a bottom area of the reservoir, and wherein the predetermined area of reservoir is a top area of the reservoir, such that the baffle is situated to direct water entering the reservoir to the top area of the reservoir.

13. The water chilling system of claim 11, wherein the cooling device comprises a thermoelectric cooling probe.

14. The water chilling system of claim 13, wherein the cooling probe extends into the reservoir from a bottom surface of the reservoir.

15. A water chilling system, comprising:
a reservoir having an inlet and an outlet;
a cooling device situated to cool water contained in the reservoir;
a baffle situated adjacent the inlet to direct water entering the reservoir to a predetermined area of the reservoir; and
a flow control device situated in the outlet.

16. The water chilling system of claim 15, wherein the cooling device is positioned in a bottom area of the reservoir, and wherein the predetermined area of reservoir is a top area of the reservoir, such that the baffle is situated to direct water entering the reservoir to the top area of the reservoir.

17. The water chilling system of claim 15, wherein the cooling device comprises a thermoelectric cooling probe.

18. The water chilling system of claim 15, further comprising:
an opening defined by the reservoir for allowing air to escape from the reservoir when the reservoir is filled with water; and
a plug for sealing the opening.

* * * * *